US007789291B2

(12) United States Patent
Andersson et al.

(10) Patent No.: US 7,789,291 B2
(45) Date of Patent: Sep. 7, 2010

(54) PACKAGING ARTICLE AND METHOD WITH PARTICULAR TEARING SLIT ARRANGEMENT

(75) Inventors: Thomas Andersson, Helsingborg (SE); Tony Alvarez, Atlanta, GA (US); Ed Cigallio, Douglasville, GA (US); Nathan Franklin, Atlanta, GA (US)

(73) Assignee: Printpack Illinois, Inc., Elgin, IL (US)

( * ) Notice: Subject to any disclaimer, the term of this patent is extended or adjusted under 35 U.S.C. 154(b) by 112 days.

(21) Appl. No.: 12/136,287

(22) Filed: Jun. 10, 2008

(65) Prior Publication Data

US 2009/0301903 A1 Dec. 10, 2009

(51) Int. Cl.

| | |
|---|---|
| ***B65D 65/28*** | (2006.01) |
| ***B65D 5/54*** | (2006.01) |
| ***B65D 85/00*** | (2006.01) |
| ***B65B 11/00*** | (2006.01) |

(52) U.S. Cl. ..... 229/87.05; 53/462; 206/215; 206/449; 229/123.2; 229/200; 383/207

(58) Field of Classification Search ..... 206/215, 206/449–455; 229/87.05, 123.2, 200; 383/203–209; 53/462

See application file for complete search history.

(56) References Cited

U.S. PATENT DOCUMENTS

| | | | | |
|---|---|---|---|---|
| 2,020,799 A | | 11/1935 | Randall | |
| 2,115,673 A | | 4/1938 | Stompe | |
| 2,170,230 A | | 8/1939 | Armstrong | |
| 2,285,542 A | * | 6/1942 | Tasker | 229/87.05 |
| 2,502,214 A | | 3/1950 | Gianninoto | |
| 4,170,305 A | * | 10/1979 | Hull et al. | 229/87.05 |
| 4,460,088 A | | 7/1984 | Rugenstein et al. | |
| 4,679,693 A | | 7/1987 | Forman | |
| 4,771,937 A | * | 9/1988 | Kamada et al. | 229/123.2 |

(Continued)

FOREIGN PATENT DOCUMENTS

| | | |
|---|---|---|
| DE | 4241423 A1 | 6/1994 |

(Continued)

OTHER PUBLICATIONS

International Search Report and Written Opinion or PCT/US2009/046878, International Search Authority.

*Primary Examiner*—Bryon P Gehman
(74) *Attorney, Agent, or Firm*—Sutherland Asbill & Brennan LLP

(57) ABSTRACT

A packaging article including a flap for opening and reclosing the packaging article. The packaging article comprises a flexible packaging material and a label. The flexible packaging material includes the flap and a plurality of slits defining at least a portion of a boundary of the flap. The plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits. A first portion of the label is affixed to a portion of the flap. A second portion of the label is adapted to be repeatedly removably adhered to a portion of the flexible packaging material adjacent the flap such that the flap can be opened and reclosed. The packaging article may be a ream wrapper.

25 Claims, 3 Drawing Sheets

U.S. PATENT DOCUMENTS

| | | | | |
|---|---|---|---|---|
| 4,874,096 | A | 10/1989 | Tessera-Chiesa | |
| 4,919,271 | A | 4/1990 | Kuchenbecker | |
| 5,040,685 | A * | 8/1991 | Focke et al. | 229/87.05 |
| 5,121,879 | A * | 6/1992 | Focke et al. | 229/87.05 |
| 5,333,735 | A * | 8/1994 | Focke et al. | 206/494 |
| 5,524,759 | A | 6/1996 | Herzberg et al. | |
| 5,622,309 | A * | 4/1997 | Matsuda et al. | 206/215 |
| 6,309,105 | B1 * | 10/2001 | Palumbo | 383/203 |
| 6,818,346 | B2 | 11/2004 | Arent | |
| 7,007,423 | B2 | 3/2006 | Andersson et al. | |
| 2003/0129431 | A1 | 7/2003 | Nowak et al. | |
| 2003/0190474 | A1 | 10/2003 | Nowak et al. | |
| 2003/0236334 | A1 | 12/2003 | Gatewood et al. | |
| 2004/0253469 | A1 | 12/2004 | Arent et al. | |
| 2005/0006265 | A1 | 1/2005 | Anderson et al. | |
| 2005/0199686 | A1 | 9/2005 | Nowak et al. | |
| 2005/0202191 | A1 | 9/2005 | Nowak et al. | |
| 2005/0202949 | A1 | 9/2005 | Nowak et al. | |
| 2005/0222339 | A1 | 10/2005 | Gatewood et al. | |
| 2006/0027637 | A1 | 2/2006 | Conrad et al. | |

FOREIGN PATENT DOCUMENTS

| | | | |
|---|---|---|---|
| EP | 0249337 | B1 | 8/1990 |
| EP | 0545136 | A1 | 6/1993 |
| SE | 463666 | B | 1/1991 |
| WO | 8001157 | | 6/1980 |
| WO | 9611147 | | 4/1996 |
| WO | 9611147 | A1 | 9/1996 |
| WO | 03059776 | A1 | 7/2003 |
| WO | 2009036745 | A1 | 3/2009 |

* cited by examiner

PACKAGING ARTICLE AND METHOD WITH PARTICULAR TEARING SLIT ARRANGEMENT

TECHNICAL FIELD

This disclosure generally relates to packaging articles, and in particular to ream wrappers and wrapped reams of paper.

BACKGROUND OF THE INVENTION

In various applications, it may be desirable to have a packaging material which protects the package contents from moisture and/or which is recloseable after the package is initially opened. For example, in the packaging of paper products comprising stacks of sheets or reams (e.g., 500 sheets), ream wrappers have been wrapped around the paper and the user must either tear the wrap or break the seal at the ends of the reams to open the ream wrap. Such a design makes access to the paper difficult and does not allow the ream wrap to be reclosed to protect any unused portion of paper for storage.

Accordingly, there is a need for a simple packaging article that will protect the contents of the package from the outside environment and which is recloseable.

SUMMARY OF THE INVENTION

This disclosure provides a packaging article including a flap for opening and reclosing the packaging article. The packaging article comprises a flexible packaging material and a label. The flexible packaging material includes the flap and a plurality of slits defining at least a portion of a boundary of the flap. The plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits. A first portion of the label is affixed to a portion of the flap. A second portion of the label is adapted to be repeatedly removably adhered to a portion of the flexible packaging material adjacent the flap such that the flap can be opened and reclosed.

This disclosure also encompasses a method for packaging a product comprising providing a packaging article having a flexible packaging material comprising a flap and a plurality of slits defining at least a portion of a boundary of the flap, providing a label, and enclosing the product in the packaging article. The plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits. A first portion of the label is affixed to a portion of the flap. A second portion of the label is adapted to be repeatedly removably adhered to a portion of the flexible packaging material adjacent the flap such that the flap can be opened and reclosed.

In addition, this disclosure encompasses a wrapped ream of paper including a flap for opening and reclosing the wrapped ream of paper. The wrapped ream of paper comprises a ream of paper, a ream wrapper, and a label. The ream wrapper includes a flexible packaging material comprising the flap and a plurality of slits defining a portion of a boundary of the flap. The plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits. A first portion of the label is affixed to a portion of the flap. A second portion of the label is adapted to be repeatedly removably adhered to a portion of the flexible packaging material adjacent the flap such that the flap can be opened and reclosed.

This disclosure further encompasses a method of forming a packaging article comprising providing a packaging material comprising a flexible packaging material and forming a plurality of slits defining at least a portion of a boundary of a flap. The plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits.

Other objects, features, and advantages of this invention will be apparent from the following detailed description, drawing, and claims.

DETAILED DESCRIPTION OF THE INVENTION

Figure 1A:
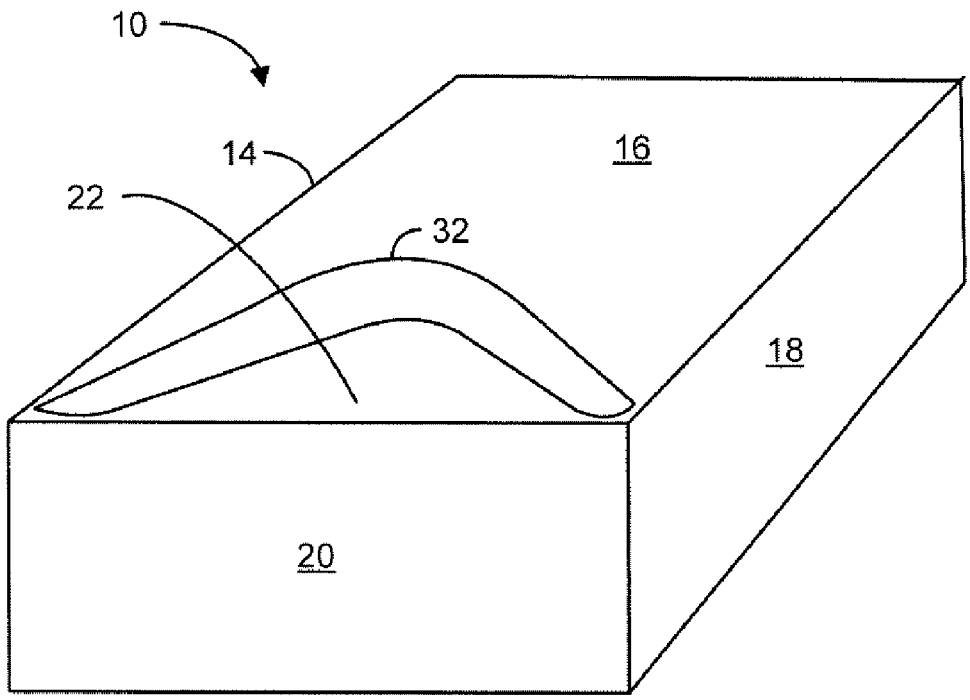
FIGS. 1A-1B illustrate perspective views of a wrapped ream of paper made in accordance with an embodiment of the present disclosure when unopened and opened, respectively.

As summarized above, this disclosure encompasses a packaging article, a method for packaging a product, a wrapped ream of paper, and a method of forming a packaging article. Embodiments of the present disclosure are described in detail below and are illustrated in FIGS. 1A-1C and 2. Though FIGS. 1A-C and 2 are illustrated and described with reference to embodiments for a wrapped ream of paper, it should be understood that any packaging article or packaged product may likewise employed or be made by alternate embodiments of the present disclosure.

Embodiments of the present disclosure include a packaging article including a flexible packaging material comprising a flap for opening and reclosing the packaging article. Suitable packaging articles for use in embodiments of the present disclosure include, but are not limited to, ream wrappers (also referred to herein as "ream wrap"), boxes, cartons, packets, pouches, bags, flexible packaging, or the like. Embodiments of the packaging article may be used to package products including, but not limited to, food, pharmaceuticals, or paper products such as facial tissue and typing paper, printer paper, and the like. Thus, embodiments of the present disclosure also include packaged products such as, but not limited to, wrapped reams of paper, soft packs of facial tissues, bags of food, or any other packaged products which may be removed from the packaging article via an opening covered by a flap.

Embodiments of the flexible packaging material may comprise any material flexible enough to allow a flap to be opened and reclosed. Suitable materials for use in embodiments of the flexible packaging material may include, but are not limited to, cellulose materials, polymer films, or combinations thereof. The cellulose material may include, but is not limited to, paper, cardboard, corrugated paper, poly-coated paper, or the like. The polymer films may include, but is not limited to, polyethylene, low density polyethylene, polypropylene, biaxially oriented polypropylene, polyester, and combinations thereof. In particular embodiments, the polymer film may have a thickness ranging from 100 gauge to 400 gauge. In more particular embodiments, the polymer film may have a thickness ranging from 100 gauge to 350 gauge.

In embodiments where the packaging article is a ream wrapper, it may be desirable that the ream wrap material should have a stiffness which makes the material suitable for use in a PEMCO wrapping machine. In specific embodiments, the packaging articles may be a ream wrapper comprising a 240 gauge polypropylene film.

Embodiments of the flexible packaging material have a flap for opening and reclosing the packaging article. As used herein, "flap" refers to any portion of embodiments of the flexible packaging material which is movable to provide access to an opening thereby allowing the contents of the packaging article to be removed and which is also movable to provide a closure over at least a portion of the opening of the packaging article.

In particular embodiments, a portion of the boundary of the flap is defined by a plurality of slits. As used herein, "slit" refers to any opening in the flexible packaging material having any shape and size so as to not allow the contents of the packaging article to pass through it, but which provides enough of a break in the flexible packaging material to be a starting point for a tear in the flexible packaging material. For instance, each of the plurality of slits may have a long narrow shape. In some embodiments, the plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits. Therefore, it should be understood that the portion or portions of the flexible packaging material between the plurality of slits can comprise any of the materials mentioned above for use as the flexible packaging material which can be torn by a person providing the tearing force.

In some embodiments, the midpoints of the length dimensions of the plurality of slits may be offset from one another. For example, the plurality of slits may be arranged on the flexible packaging material such that the midpoints of their length dimensions form a shape comprising an angle (e.g., a V-shape or 90-degree angle shape), an arc, or rectangular shape. It should be understood that other configurations of the plurality of slits may be possible so that different sizes and shapes of embodiments of the flap are defined. In alternate embodiments, one portion of the boundary of the flap may be defined by slits having a length dimension substantially perpendicular to a tearing force and additional other slits or perforations, which are aligned or otherwise oriented in relation to the tearing force.

Embodiments of the packaging article also include a label affixed to a portion of the flap. As used herein, "label" refers any tab, sticker, decal, slip, or the like which may be affixed to the flap and grasped by a person. In particular embodiments, a portion of the label is adapted to be repeatedly removably adhered to a portion of the flexible packaging material adjacent to the flap. In some embodiments, the label may comprise an adhesive label which includes a permanent adhesive for affixing the label to the flap and/or a reuseable pressure sensitive adhesive for repeatedly removal and adherence of the label to a portion of the flexible packaging material adjacent to the flap. In alternate embodiments, the label may comprise other materials, such as tape, or methods, such as chemical bonding, for attaching the label to the flap and other materials, such as static cling materials, for repeatedly removal and adherence to the flexible packaging material adjacent the flap. It should be understood by a person of ordinary skill in the art that any material or combination of materials which includes a portion that can be affixed to a portion of the flap so that the material(s) is not removed during opening and closing of the flap and a portion which can be repeatedly removed and adhered to the flexible packaging material adjacent to the flap can be used in embodiments of the label.

In particular embodiments, the label may cover one or more of the plurality of slits. In other embodiments, the label may cover a majority of the plurality of slits. In still other embodiments, the label may cover substantially all of the plurality of slits. In some embodiments, the label provides a partial moisture seal when the label is adhered to the flexible packaging material in a closed position, before the initial opening of the flap and/or after the reclosing of the flap. In other embodiments, the label may provide a complete moisture seal when the label is adhered to the flexible packaging material in a closed position, before the initial opening of the flap and/or after the reclosing of the flap. For example, the label may cover all of the plurality of slits so that the label provides a complete moisture seal. In such embodiments, the label may comprise substantially fluid impermeable materials or materials selectively impermeable to particular fluids. For example, the label may comprise, but is not limited to, a plastic film or poly-coated paper.

Embodiments of the packaging articles may be used in embodiments of the wrapped reams of paper of the present disclosure. In particular embodiments, the wrapped reams of paper include a ream of paper, a ream wrapper having a flap for opening and reclosing the wrapped ream of paper, and a label. More particularly, embodiments of the ream wrapper may comprise a flexible packaging material including a flap and a plurality of slits defining a portion of a boundary of the flap as described herein in reference to the embodiments of the packaging articles. In addition, embodiments of the label of the wrapped ream of paper may comprise a label as described herein in reference to the packaging article. Therefore, the embodiments of the elements of the packaging article described herein may be used in embodiments of wrapped ream of paper for analogous elements.

Figure 1B:
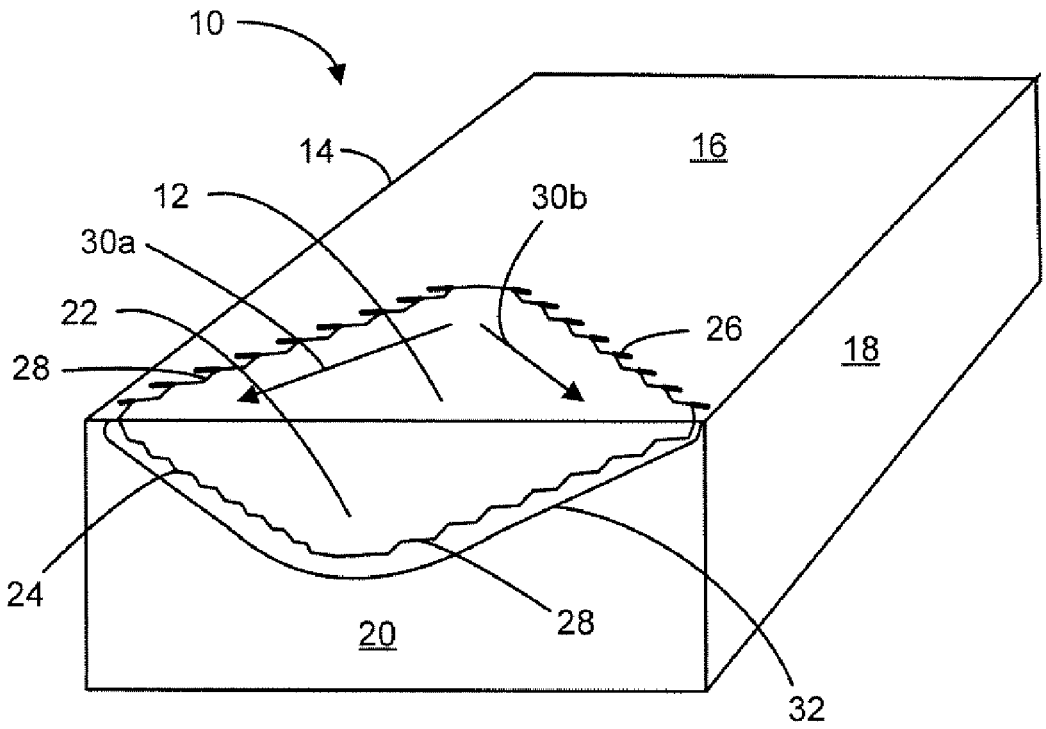
Figure 1C:
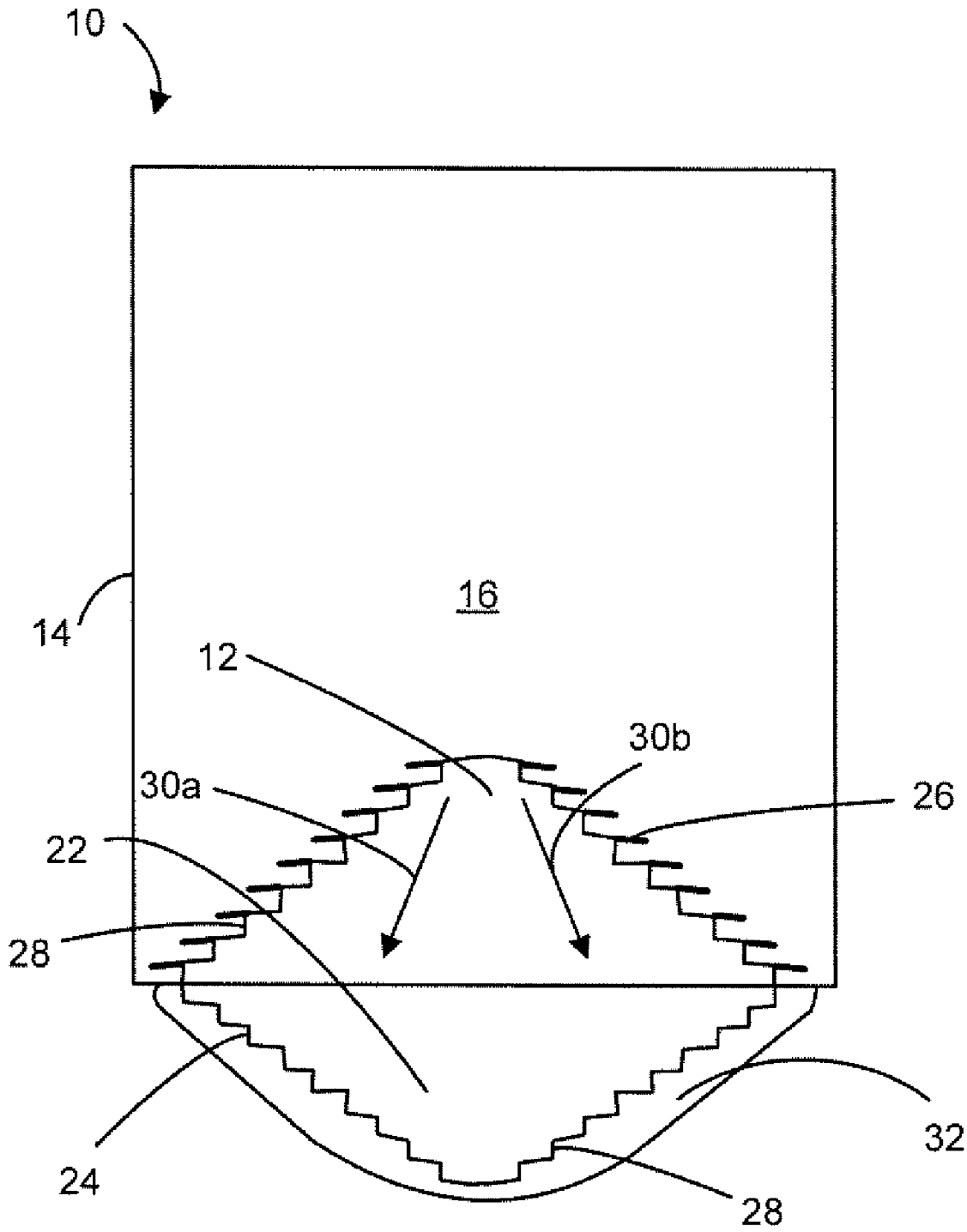
FIG. 1C illustrates a top view of the wrapped ream of paper made in accordance with an embodiment of the present disclosure when opened.

FIGS. 1A-1B illustrate a packaged product 10 comprising a wrapped ream of paper made in accordance with an embodiment of the present disclosure. FIG. 1A illustrates the wrapped ream of paper 10 closed so that the contents are not accessible while FIG. 1B illustrates the wrapped ream of paper opened so that the contents can be removed. FIG. 1C illustrates a top view of the wrapped ream of paper opened. Although FIGS. 1A-1C are described in terms of a wrapped ream of paper 10, this disclosure is applicable to any type of packaged product which may be removed from the packaging article via an opening covered by a flap.

The wrapped ream of paper 10 comprises a ream of paper 12 packaged in a ream wrapper 14 comprising a flexible packaging material having a top surface 16, a bottom surface (hidden from view), opposed side surfaces 18, and opposed end surfaces 20. The wrapped ream of paper 10 also includes a flap 22 on the top surface 16 of the ream wrapper 14. The boundary 24 of the flap 22 is defined by a plurality of slits 26 and portions 28 of the top surface 16 which are torn by a tearing force 30. The wrapped ream of paper 10 also includes a label 32. A portion of the label 32 is affixed to the flap 22 and another portion of the label can be repeatably removed and adhered to the portion of the top surface 16 of the flexible packaging material adjacent to the flap. In this particular embodiment, the label 32 covers all of the plurality of slits when the flap is closed or reclosed.

Figure 2:
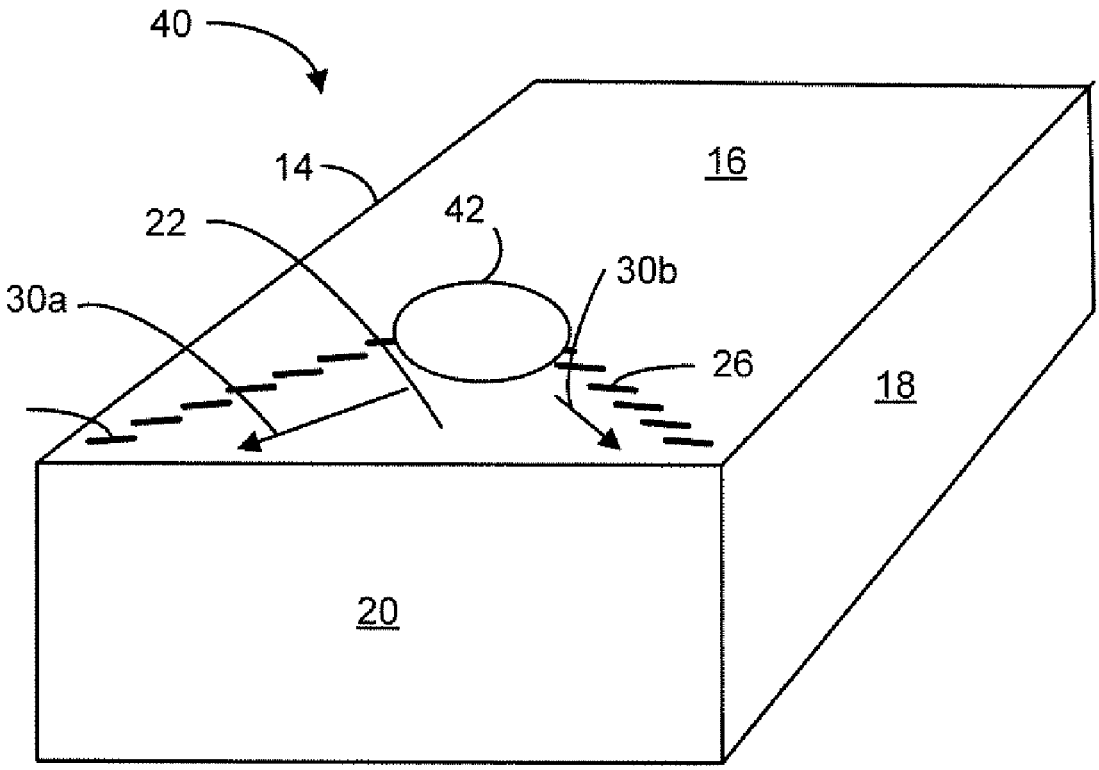
FIG. 2 illustrates a perspective view of a wrapped ream of paper made in accordance with another embodiment of the present disclosure.

FIG. 2 illustrates another embodiment of a packaged product 40 comprising a wrapped ream of paper. For ease of reference, like elements in FIG. 2 are labeled with like numerals as in FIGS. 1A-C. The wrapped ream of paper 40 is closed, as before the flap 22 is opened for the first time (e.g., during storage or transport of the wrapped ream of paper). The label 42 only covers a portion of the plurality of slits 26. When it is desired to remove some or all of the paper in the wrapped ream of paper 40, the portion of the label 42 which can be repeatedly removed and adhered to the portion of the top surface 16 adjacent to the flap 22 can be gripped by a person and pulled simultaneously away from the top surface and in the direction of the end surface 20 shown. Thus, a tearing force 30 is created by this movement of the label 42, which is sufficient to tear portions of the top surface 16 lying between the plurality of slits 26. Use of the wrapped reams of paper and packaging articles is discussed in further detail below.

The present disclosure also encompasses a method of making a packaging article comprising providing a packaging article including a flexible packaging material comprising a flap and a plurality of slits defining at least a portion of a boundary of the flap, providing a label, and enclosing the product in the packaging article. The packaging article provided in embodiments of this method may comprise a flexible packaging material including a flap and a plurality of slits defining a portion of a boundary of the flap as described herein in reference to the embodiments of the packaging articles. In addition, the label provided in embodiments of this method may comprise a label as described herein in reference to the packaging article. In some embodiments, the packaging article may comprise a ream wrapper and the product may comprise a ream of paper.

Thus, the present disclosure additionally encompasses a method for wrapping a ream of paper comprising providing a ream wrapper including a flexible packaging material comprising a flap and a plurality of slits defining at least a portion of a boundary of the flap, providing a label, and wrapping the ream of paper in the ream wrapper. The ream wrapper provided in embodiments of this method may comprise a flexible packaging material including a flap and a plurality of slits defining a portion of a boundary of the flap as described herein in reference to the embodiments of the packaging articles. In addition, the label provided in embodiments of this method may comprise a label as described herein in reference to the packaging article.

The present disclosure further encompasses a method of making a packaging article comprising providing a packaging material including a flexible packaging material and forming a plurality of slits defining at least a portion of a boundary of a flap. The plurality of slits are substantially parallel to and spaced from one another and have a length dimension. When applying to the flap a tearing force directed substantially perpendicularly to the length dimensions of the plurality of slits, the flap can be opened by the tearing force tearing the flexible packaging material between the plurality of slits. In particular embodiments, the plurality of slits formed in embodiments of the present method may be as described herein in reference to the embodiments of the packaging articles.

Embodiments of the method of making a packaging article may further comprise providing a label. A first portion of the label is affixed to a portion of the flap. A second portion of the label is adapted to be repeatedly removably adhered to a portion of the flexible packaging material adjacent the flap such that the flap can be opened and reclosed. The label provided in embodiments of this method may comprise a label as described herein in reference to the packaging article. In particular embodiments of this method, the packaging article is a ream wrapper.

Embodiments of this method may include forming the plurality of slits by die cutting, punching, perforating, scoring, or hand cutting the plurality of slits. Embodiments of this method can be used in-line with a wrapping machine, such as a PEMCO machine, or can be performed off-line. For example, a flexible packaging material may be unwound, die cut, and affixed with a label upon registration to align the label and then immediately sent into a PEMCO machine. In alternate embodiments, the ream material may be die cut and affixed with a label before being sent to a ream wrap site. Furthermore, some embodiments may have the die cutting performed off-line while the label is affixed in-line with a PEMCO machine.

In use, embodiments of the label allow the flap to be opened by moving the label, and the flap along with the label, to provide the tearing force to open the packaging article. In one instance, the label can be grasped and pulled in a direction simultaneously directed away from the surface of the packaging article and towards the flap to provide a tearing force which tears a portion of the flexible packaging material between the plurality of slits so that the flap is partially separated from the flexible packaging material adjacent to the flap and an opening is defined in the packaging article for removal of its contents. In addition, embodiments of the label allow for the flap to be reclosed by repositioning the label on the flexible packaging material adjacent to the flap so that the flap is moved into a closed position over the opening in the packaging article.

Without being bound by theory, embodiments of the packaging article of the present disclosure allow materials which have less tensile strength and/or tear strength to be used as the flexible packaging material as compared to other prior art packaging articles comprising flaps defined in the packaging article. Examples of such materials having less tensile strength and/or tear strength as compared to prior art packaging articles include, but are not limited to, 240 gauge polypropylene film or other cellulose materials, polymer films, or combinations thereof. In particular, the positioning of the length dimension of the plurality of slits perpendicular to the tearing force results in the flap being less likely to be opened accidentally during handling in storage, transport, at a point of sale, or at a consumer site. For example, for a packaging article that is a ream wrapper, the portions of the flexible packaging material lying between the plurality of slits are less likely to tear when a wrapped ream of paper is dropped on its side surface, on its corner, or while in a shipping carton with other wrapped reams of paper than slits which are aligned or almost aligned with the tearing force. Moreover, the greater weight of the ream of paper as compared to other products such as pocket pack stacks of facial tissues makes the risk of unintentional rupture more likely when a ream of wrapped paper is dropped. The likelihood of embodiments of a wrapped ream of paper of the present disclosure rupturing unintentionally at the plurality of slits is further decreased by the use of a label covering at least a portion of the slits.

Again without being bound by theory, embodiments of the packaging article allow materials which have less tear strength and/or tensile strength to be used as the packaging article when a label is used which covers at least a portion of the slits (e.g., FIG. 2), a majority of the slits, or all of the plurality of slits (e.g., FIGS. 1A-1C). In particular, covering a portion of the slits with the label decreases the likelihood that the portions of the flexible packaging material between the plurality of slits unintentionally tear or rupture because the label traverses the portion of the slits it covers and any unintentional tear or rupture would have to result after the label becoming removed from the flexible packaging material adjacent to the flap or the tearing of the label. Thus, in particular embodiments, the label may comprise a material having a greater tensile and/or tear strength than the packaging article. Such an embodiment would still allow for cost savings and/or better ease of handling of the packaging article by using materials which have less tensile strength and/or tear strength for the packaging article. For example, a thinner cellulose material or polymer film could be used as compared to a packaging article not having the features of (1) a flap a boundary defined by a plurality of slits and having length dimension of the plurality of slits perpendicular to the tearing force and/or (2) a label covering at least a portion of the plurality of slits. In other embodiments, such as when the packaging article is a ream wrapper, the packaging article may comprise a flexible packaging material having a stiffness that is required for processing (e.g., packaging of a product), but which is more likely to tear during handling or dropping of the ream wrapper. By producing such ream wrappers with a flap a boundary defined by a plurality of slits and having length dimension of the plurality of slits perpendicular to the tearing force and/or a label covering at least a portion of the plurality of slits, the increased likelihood of unintentional rupture is lessened or mitigated.

Moreover, the use of a label which covers the all of the plurality of slits allows such embodiments of the packaging article to be used to keep the contents of the package protected from the exterior environment. For example, particular embodiments of wrapped reams of paper may include a ream wrapper comprising a polymer film having moisture barrier properties and a label with moisture barrier properties to prevent the paper contained within from warping or discoloring during storage before and after the ream wrapper is initially opened, as the flap may be reclosed and the label re-adhered to the flexible packaging material adjacent to the flap. Thus, portions of a ream of paper may be stored in the ream wrapper by a consumer after the initial opening of the wrapped ream of paper.

It should be understood that the foregoing relates to particular embodiments and that numerous changes may be made therein without departing from the scope of this disclosure as defined from the following claims.

We claim:

1. A packaging article including a flap for opening and reclosing the packaging article, the packaging article comprising:

a flexible packaging material comprising the flap and a plurality of slits defining at least a portion of a boundary of the flap, wherein the plurality of slits are substantially parallel to and spaced from one another and have a length dimension such that when applying to the flap a tearing force directed substantially perpendicularly to the length dimensions of the plurality of slits the flap can be opened by the tearing force tearing the flexible packaging material between the plurality of slits, wherein the plurality of slits are arranged such that the length dimensions are oriented in a substantially perpendicular direction in relation to the tearing force when opening the packaging article by the flap; and a label, wherein a first portion of the label is affixed to a portion of the flap, and wherein a second portion of the label is adapted to be repeatedly removably adhered to a portion of the flexible packaging material adjacent the flap such that the flap can be opened and reclosed.

2. The packaging article of claim 1, wherein the packaging article is a ream wrapper.

3. The packaging article of claim 1, wherein a midpoint of the length dimension of each of the plurality of slits is offset from one another.

4. The packaging article of claim 3, wherein the plurality of slits are arranged such that the midpoints of the length dimensions of each of the plurality of slits form a shape comprising an angle or an arc.

5. The packaging article of claim 1, wherein the label covers at least one of the plurality of slits.

6. The packaging article of claim 1, wherein the label covers a majority of the plurality of slits.

7. The packaging article of claim 1, wherein the flexible packaging material comprises a polymer film, a cellulose material, or combinations thereof.

8. The packaging article of claim 1, wherein the flexible packaging material comprises a polymer film having a thickness ranging from 100 gauge to 400 gauge.

9. A method for packaging a product comprising:

providing a packaging article comprising a flexible packaging material, the flexible packaging material comprising a flap and a plurality of slits defining at least a portion of a boundary of the flap, wherein the plurality of slits are substantially parallel to and spaced from one another and have a length dimension such that when applying to the flap a tearing force directed substantially perpendicularly to the length dimensions of the plurality of slits the flap can be opened by the tearing force tearing the flexible packaging material between the plurality of slits, wherein the plurality of slits are arranged such that the length dimensions are oriented in a substantially perpendicular direction in relation to the tearing force when opening the packaging article by the flap;

providing a label, wherein a first portion of the label is affixed to a portion of the flap, and wherein a second portion of the label is adapted to be repeatedly removably adhered to a portion of the flexible packaging material adjacent the flap such that the flap can be opened and reclosed; and enclosing the product in the packaging article.

10. The method of claim 9, wherein a midpoint of the length dimension of each of the plurality of slits is offset from one another.

11. The method of claim 9, wherein the step of providing the label comprises adhering the label to the flexible packaging material so that the label covers at least one of the plurality of slits.

12. The method of claim 9, wherein the product comprises a ream of paper.

13. A wrapped article including a flap for opening and reclosing the wrapped article, the wrapped article comprising:

a ream of paper;

a ream wrapper comprising a flexible packaging material, the flexible packaging material comprising the flap and a plurality of slits defining at least a portion of a boundary of the flap, wherein the plurality of slits are substantially parallel to and spaced from one another and have a length dimension such that when applying to the flap a tearing force directed substantially perpendicularly to the length dimensions of the plurality of slits the flap can be opened by the tearing force tearing the flexible packaging material between the plurality of slits, wherein the plurality of slits are arranged such that the length dimensions are oriented in a substantially perpendicular direction in relation to the tearing force when opening the packaging article by the flap; and a label, wherein a first portion of the label is affixed to a portion of the flap, and wherein a second portion of the label is adapted to be repeatedly removably adhered to a portion of the flexible packaging material adjacent the flap such that the flap can be opened and reclosed.

14. The wrapped article of claim 13, wherein a midpoint of the length dimension of each of the plurality of slits is offset from one another.

15. The wrapped article of claim 14, wherein the plurality of slits are arranged such that the midpoints of the length dimensions of each of the plurality of slits forms a shape comprising an angle or an arc.

16. The wrapped article of claim 13, wherein the tearing force is substantially directed towards a midpoint of the length dimension of each of the plurality of slits.

17. The wrapped article of claim 13, wherein the label covers at least one of the plurality of slits.

18. The wrapped article of claim 17, wherein the label covers a majority of the plurality of slits.

19. The wrapped article of claim 13, wherein the label provides at least a partial moisture seal when the label is adhered to the portion of the flexible packaging material adjacent the flap before the flap is opened and when the flap is reclosed.

20. The wrapped article of claim 13, wherein the second portion of the label is adapted to be pulled away from the portion of the flexible packaging material adjacent the flap to provide the tearing force.

21. The wrapped article of claim 13, wherein the ream wrapper comprises a polymer film, a cellulose material, or combinations thereof

22. The wrapped ream article of claim 21, wherein the ream wrapper comprises a polymer film having a thickness ranging from 100 gauge to 400 gauge.

23. A method of forming a packaging article comprising:

providing a flexible packaging material having a surface;

forming a plurality of slits defining at least a portion of a boundary of a flap, wherein the plurality of slits are substantially parallel to and spaced from one another and have a length dimension such that when applying to the flap a tearing force directed substantially perpendicularly to the length dimensions of the plurality of slits the flap can be opened by the tearing force tearing the flexible packaging material between the plurality of slits, wherein the plurality of slits are arranged such that the length dimensions are oriented in a substantially perpendicular direction in relation to the tearing force when opening the packaging article by the flap.

24. The method of claim 23, further comprising providing a label, wherein a first portion of the label is affixed to a portion of the flap, and wherein a second portion of the label is adapted to be repeatedly removably adhered to a second portion of the surface adjacent the flap such that the flap can be opened and reclosed.

25. The method of claim 23, wherein the packaging article is a ream wrapper.

* * * * *